US009388958B2

(12) United States Patent
Watson

(10) Patent No.: US 9,388,958 B2
(45) Date of Patent: Jul. 12, 2016

(54) WALL WASHING LAMP

(71) Applicant: Lucifer Lighting Company, San Antonio, TX (US)

(72) Inventor: Frank Watson, San Antonio, TX (US)

(73) Assignee: LUCIFER LIGHTING COMPANY, San Antonio, TX (US)

( * ) Notice: Subject to any disclaimer, the term of this patent is extended or adjusted under 35 U.S.C. 154(b) by 143 days.

(21) Appl. No.: 14/258,658

(22) Filed: Apr. 22, 2014

(65) Prior Publication Data

US 2014/0313737 A1 Oct. 23, 2014

Related U.S. Application Data

(60) Provisional application No. 61/814,695, filed on Apr. 22, 2013.

(51) Int. Cl.

| | |
|---|---|
| ***F21V 15/00*** | (2015.01) |
| ***F21V 17/00*** | (2006.01) |
| ***F21V 7/00*** | (2006.01) |
| ***F21V 3/04*** | (2006.01) |
| ***F21V 13/04*** | (2006.01) |
| *F21S 8/02* | (2006.01) |
| *F21V 5/04* | (2006.01) |

(52) U.S. Cl.

CPC . *F21V 7/00* (2013.01); *F21V 3/049* (2013.01); *F21V 13/04* (2013.01); *F21S 8/026* (2013.01); *F21V 5/045* (2013.01)

(58) Field of Classification Search

CPC ..... F21S 8/02–8/028
USPC ..... 362/364–366
See application file for complete search history.

(56) References Cited

U.S. PATENT DOCUMENTS

| | | | | |
|---|---|---|---|---|
| 2,716,185 | A | 8/1955 | Burliuk et al. | 362/366 |
| 3,643,089 | A | 2/1972 | Marantz | 362/217.02 |
| 4,475,147 | A | 10/1984 | Kristofek | 362/148 |
| 6,632,006 | B1 | 10/2003 | Rippel et al. | 362/366 |
| 6,994,456 | B1 * | 2/2006 | Russo | F21S 8/02 362/147 |
| 7,125,135 | B2 | 10/2006 | Ward | 362/147 |
| 7,575,345 | B2 | 8/2009 | Gauthier et al. | 362/366 |
| 7,748,868 | B2 | 7/2010 | Patti et al. | 362/269 |
| 7,789,522 | B2 | 9/2010 | Steadman | 362/147 |
| 8,096,670 | B2 | 1/2012 | Trott et al. | 362/147 |
| 2007/0258233 | A1 | 11/2007 | Gray | 362/148 |
| 2009/0059600 | A1 | 3/2009 | Steadman | 362/310 |

* cited by examiner

*Primary Examiner* — Sean Gramling
(74) *Attorney, Agent, or Firm* — Norton Rose Fulbright US LLP

(57) ABSTRACT

This disclosure includes light fixtures, some of which include a lower housing that defines a first channel and has first and second ends, where the first end defines an aperture and the second end has a first mounting surface disposed at a non-parallel first angle relative to a plane of the aperture, an upper housing that defines a second channel and has first and second ends, where the second end has a light mount and the first end has a second mounting surface disposed at a non-parallel second angle relative to a plane of the light mount, and a diffuser configured to be coupled between housings, where the upper and lower housings can be coupled at the first and second mounting surfaces such that the light mount is disposed at a non-parallel third angle relative to the plane of the aperture. Some light fixtures have unitary lower and upper housings.

15 Claims, 6 Drawing Sheets

WALL WASHING LAMP

CROSS-REFERENCE TO RELATED APPLICATIONS

This application claims priority to U.S. Provisional Application No. 61/814,695 filed on Apr. 22, 2013, the contents of which are hereby incorporated by reference in their entirety.

BACKGROUND

1. Field of the Invention

The invention relates generally to light fixtures, and more particularly, but not by way of limitation, to surface washing light fixtures.

2. Description of Related Art

Light washing, a feature provided by light fixtures sometimes referred to as "washer" fixtures, can be used when broad uniform illumination of a surface or other area is desired (e.g., as opposed to a more focused illumination as may be provided by a spot light). While light washing can be performed on any surface, such surfaces are typically planar, for example, walls, floors, ceilings, and/or the like.

Light sources typically emanate light from a small and discrete location (e.g., "point" light sources), and therefore, difficulties may exist when using such point light sources to broadly and uniformly illuminate a surface (e.g., bright spots, hyperbolic shadowing, uneven color temperature, and/or glare, and/or otherwise non-uniform illumination may result).

SUMMARY

Some embodiments of the present fixtures may be configured, through a light source angularly disposed relative to an aperture and a diffuser angularly disposed relative to both the light source and the aperture, to provide uniform light washing of a surface. Some embodiments may be configured to accomplish such functionality through one or more reflector(s) disposed between the light source and the diffuser and/or between the diffuser and the aperture.

Some embodiments of the present fixtures comprise a lower housing defining a first channel and having first and second ends, the first end defining an aperture and the second end having a first mounting surface disposed at a non-parallel first angle relative to a plane of the aperture, an upper housing defining a second channel and having a first end and a second end, the second end comprising a light mount and the first end comprising a second mounting surface disposed at a non-parallel second angle relative to a plane of the light mount, and a diffuser configured to be disposed between the first mounting surface and the second mounting surface, where the first mounting surface is configured to be coupled to the second mounting surface to couple the lower housing to the upper housing such that the light mount is disposed at a non-parallel third angle relative to the aperture. In some embodiments, the light mount is configured to receive a light source having a primary aperture, and the plane of the light mount is substantially parallel with a plane defined by the primary aperture. In some embodiments, the third angle is substantially equal to the first angle minus the second angle. In some embodiments, the first angle is approximately two times the second angle. In some embodiments, the first angle is approximately 30 degrees. In some embodiments, the aperture is substantially rectangular.

Some embodiments further comprise a first reflector disposed in the first channel. In some embodiments, the first reflector comprises a cross-section with a straight outer edge facing towards the first channel. In some embodiments, the first reflector comprises a cross-section with a curved outer edge facing towards the first channel. In some embodiments, the lower housing has a first side and a second side at which the first and second ends of the lower housing are further apart than at the first side, and the first reflector is disposed on an interior surface of the first channel closer to the first side than the second side.

Some embodiments further comprise a second reflector disposed in the second channel. In some embodiments, the second reflector comprises a cross-section with a straight outer edge facing towards the second channel. In some embodiments, the second reflector comprises a cross-section with a curved outer edge facing towards the second channel. In some embodiments, the upper housing has a first side and a second side at which the first and second ends of the upper housing are further apart than at the first side, and the second reflector is disposed on an interior surface of the second channel closer to the second side than the first side.

Some embodiments further comprise a lip extending inward from an interior surface of the first channel closer to the second end than the first end, the lip having a surface configured to support the diffuser.

Some embodiments of the present fixtures comprise a housing having a first end, a second end, and defining a channel, the first end defining an aperture, and the second end having a light mount disposed at a non-parallel first angle relative to a plane of the aperture, and a substantially planar light diffuser disposed within the channel such that the light diffuser transects at least a portion of the channel and is disposed at a non-parallel second angle relative to the plane of the aperture, where the second angle is larger than the first angle. In some embodiments, the second angle is approximately two times the first angle. In some embodiments, the aperture is substantially rectangular.

Some embodiments further comprise a first reflector disposed in the channel between the second end and the diffuser. Some embodiments further comprise a second reflector disposed in the channel between the first end and the diffuser.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, 10, and 20 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DESCRIPTION OF ILLUSTRATIVE EMBODIMENTS

Figure 1A:
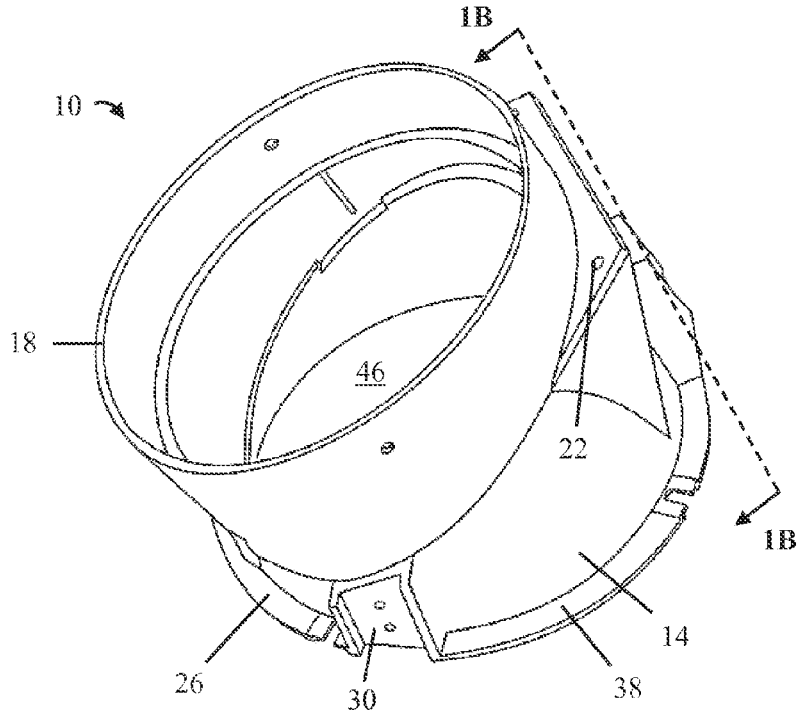
FIGS. 1A and 1B depict perspective and side cross-sectional views, respectively, of a lower housing and an upper housing of a first embodiment of the present fixtures.
Figure 1B:
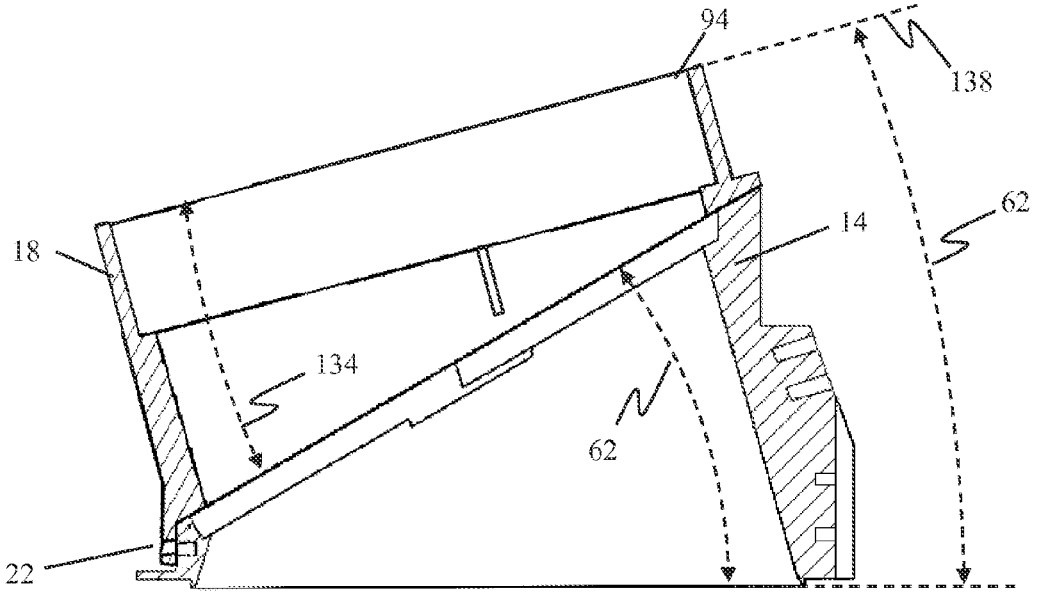
Figure 1C:
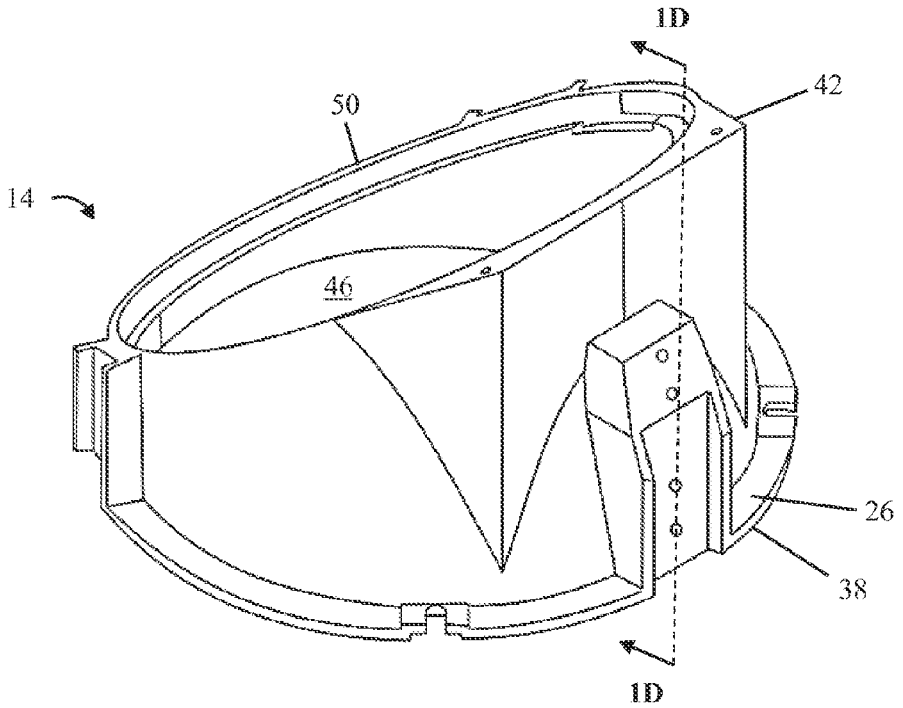
FIGS. 1C and 1D depict perspective and side cross-sectional views, respectively, of the lower housing of the first embodiment.

Referring now to the drawings, and more particularly to FIGS. 1A-1C, shown therein and designated by the reference numeral 10 is a first embodiment of the present fixtures. In the embodiment shown, fixture 10 comprises a lower housing 14 and an upper housing 18. As will be described in more detail below, in the depicted embodiment, upper housing 18 and lower housing 14 are generally wedge shaped (e.g., each having a narrow side and a wide side) and are configured to be coupled together (e.g., by fasteners, which for example, can be disposed through holes 22) such that the narrow side of each housing is generally coupled to the wider side of the other housing (e.g., as shown). The upper and lower housings and/or any other components of the present fixtures can comprise any suitable material, such as, for example, metals (e.g., aluminum, copper, alloys, such as ADC12, and/or the like), composites (e.g., plastic, carbon fiber, and/or the like), and/or the like. Additionally, such housings and other components can be finished in any suitable fashion, such as, for example, anodized, glazed, painted, polished, and/or the like. In the embodiment shown, fixture 10 comprises a flange 26 configured to be coupled to a structure (e.g., a ceiling, wall, floor, and/or any other surface) and/or an optional trim ring 182 as described below. In the embodiment shown, fixture 10 further comprises one or more hardware mounting surfaces 30 (e.g., generally planar structures which may be bounded by projections to define a mounting surface or slot which may in turn comprise holes for receiving fasteners, as shown). Such mounting surfaces can be used to mount various mounting hardware and/or other components (e.g., light sources, light control hardware (e.g., LED drivers), heat sinks, light enclosures, other components, and/or the like, which may, for example, be mounted to mounting arms (FIG. 4)).

Figure 1D:
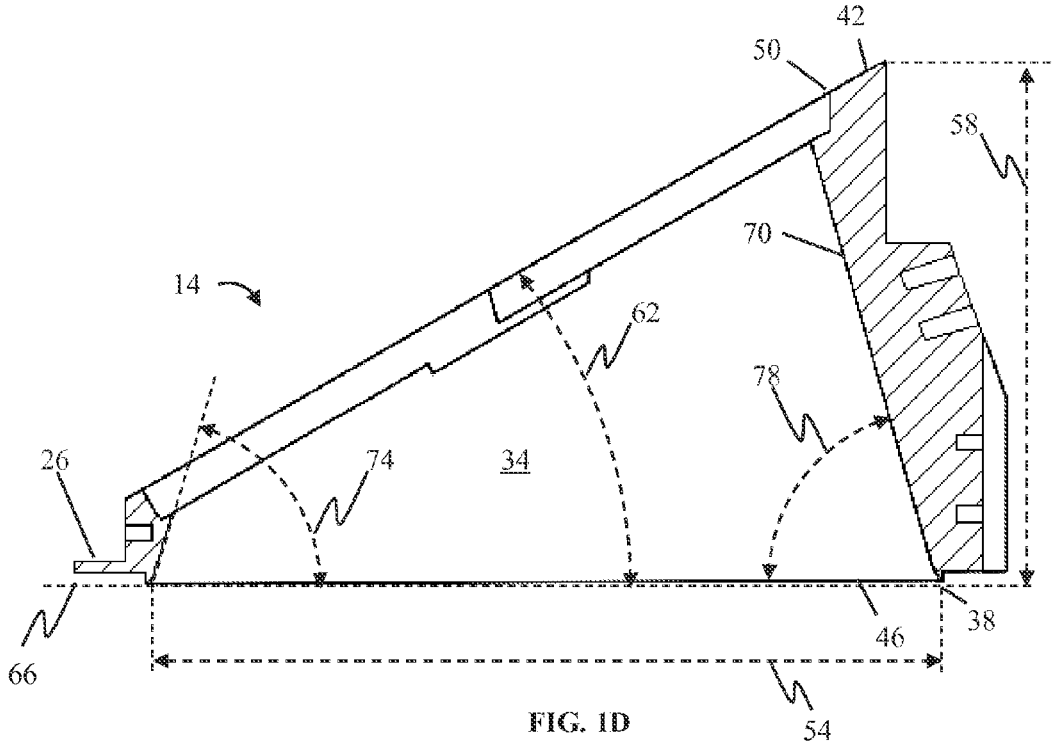
Figure 1E:
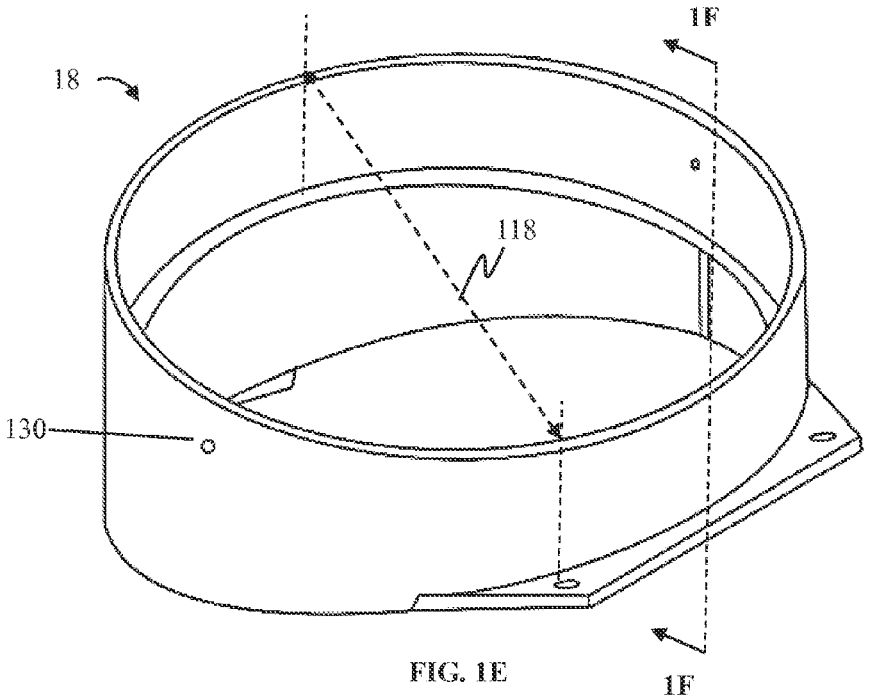
FIG. 1E depicts a perspective view of the upper housing of the first embodiment.

As shown in the depicted embodiment, lower housing 14 defines a first channel 34 extending between a first end 38 and a second end 42. In the embodiment shown first end defines an aperture or opening 46 and second end 42 defines a first mounting surface 50 (FIG. 1C). In this embodiment, aperture or opening 46 has a transverse dimension 54 of approximately 4.5 inches (in) (e.g., 4.510 in), and a height 58 of approximately 3 in (e.g., 2.944 in); however, in other embodiments, the present fixtures and/or components can comprise any suitable dimensions. In the embodiment shown, first mounting surface 50 is disposed at a non-parallel first angle 62 relative to a plane 66 (e.g., shown in side view in FIG. 1D) of aperture 46, flange 26, and/or a trim ring 182 (e.g., while not required in all embodiments, in the embodiment shown, aperture 30, flange 12, and trim ring 182 are each substantially planar and are substantially parallel with one another). In the embodiment shown, first channel 34 has an interior surface 70 that tapers outwardly from second end 42 to first end 38 (e.g., defining a generally conical volume). For example, in this embodiment, angles 74 and 78 can substantially define the taper of first channel 34 and are each about 75 degrees (e.g., approximately 75.3 degrees and 73.6 degrees, respectively). In other embodiments, angles 74 and 78 can be any suitable angle, such as, for example, 0, 5, 10, 15, 20, 25, 30, 35, 40, 45, 60, 75 degrees or larger, and/or angle 74 need not be equal or substantially equal to angle 78. In yet other embodiments, interior surface 70 may be curved to form portions of first channel 34 having and/or resembling a revolved parabolic, elliptical, circular, and/or otherwise curved section (e.g., similar to a trumpet bell), such as, for example to facilitate dispersion of light from fixture 10 (e.g., to enhance the effect of emitted light).

In the depicted embodiment, upper housing 18 defines a second channel 82 and has a first end 86 and a second end 90, where the second end comprises and/or defines a light mount 94. In this embodiment, light mount 94 is defined in part by a recessed portion 98 having a shelf 102 configured to support and/or secure a light source 106, which may comprise a primary reflector 110, as shown. In this embodiment, first end 86 of upper housing 18 comprises a second mounting surface 114. In the embodiment shown, light mount 94 (e.g., recessed portion 98) has a transverse dimension 118 of approximately 4.5 in (e.g., 4.427 in), and second channel 82 has a transverse dimension 122 of approximately 4 in (e.g., 4.154 in). In other embodiments, the present fixtures and/or components can comprise any suitable dimensions. As described above for lower housing 14, an interior surface 126 of second channel 82 can be tapered. For example, in the embodiment shown, the interior surface tapers outwardly from second end 90 to first end 86 by an angle of approximately 1 degree on each side. In other embodiments, the second channel can have any suitable geometry (e.g., and can include some or all of the features described above for lower housing 14).

Figure 1F:
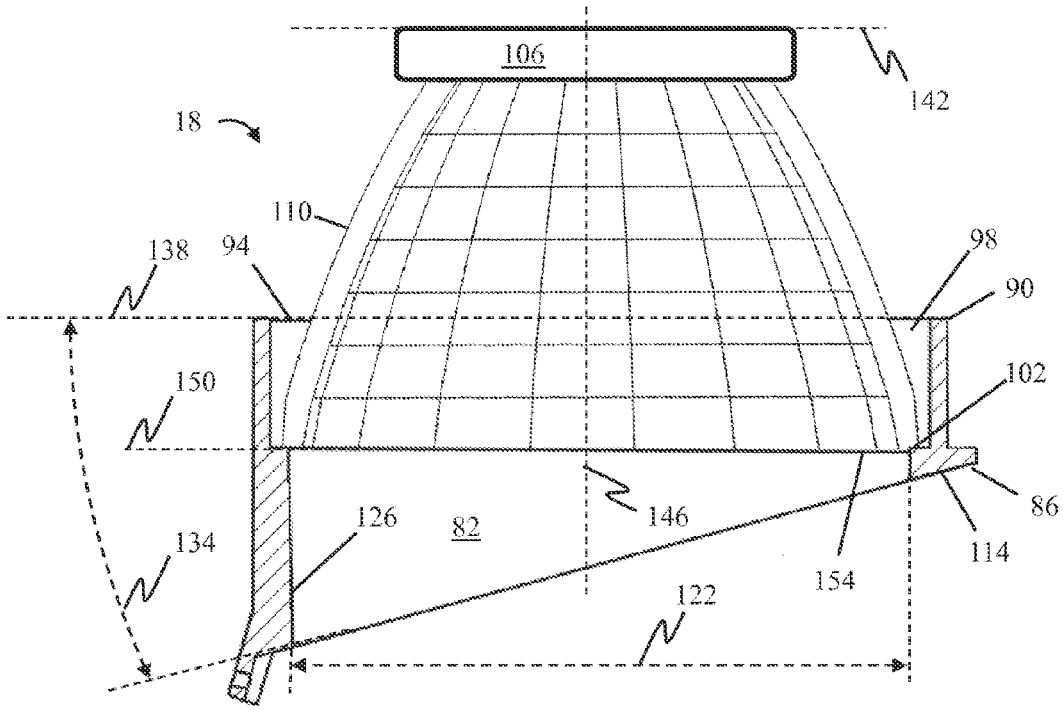
FIG. 1F depicts a side cross-sectional view of the upper housing of the first embodiment coupled to a light source.

In the embodiment shown, light mount 94 comprises one or more holes 130 configured to receive fasteners (e.g., screws, rivets, nuts and bolts, and/or the like) to couple a light source to the light mount. Other embodiments can include any suitable different and/or additional structure (e.g., adhesive, interlocking features disposed on a light source, and/or light mount 94, and/or the like). In the embodiment shown, second mounting surface 114 is disposed at a non-parallel second angle 134 relative to a plane 138 (e.g., shown in side view in FIG. 1F) of light mount 94. For example, in the depicted embodiment, plane 138 can be defined relative to a light source 106 (e.g., that the upper housing 18 can be configured to receive, as shown). For example, plane 138 can be defined as parallel with a mounting surface 142 for a light source (e.g., as shown) and/or as perpendicular to a longitudinal axis 146 of light source 106 (e.g., a direction aligned with a central axis of a primary reflector 110, if present). By way of further example, plane 138 can be substantially parallel to a plane 150 of a primary aperture 154 of light source 106 (e.g., an aperture through which light source 106 emits light such as through primary reflector 110).

In the embodiment shown, first mounting surface 50 is configured to contact second mounting surface 114 when lower housing 14 is coupled to upper housing 18 (e.g., as shown in FIG. 1B) such that light mount 94 (e.g., and/or plane 138 of light mount) is disposed at a non-parallel third angle 158 relative to plane 66 of aperture or opening 46. As shown, angles 62 and 134 defined by the housings, 14 and 18, respectively, determine third angle 158. For example, in the embodiment shown, third angle 158 is substantially equal to first angle 62 minus second angle 134. In this embodiment, the first angle is approximately two times the second angle such that third angle 158 is substantially equal to the second angle. In the embodiment shown, the first angle is approximately 30 degrees. In other embodiments first angle 62 and/or second angle 134 can be any suitable angle, such as, for example, greater than any one of or between any two of 0, 5, 10, 15, 20, 25, 30, 35, 40, 45, 50, 55, 60, 75, 90 degrees, or larger. By way of further example, in some embodiments, lower housing 14 and upper housing 18 can be coupled such that the first angle and second angle are additive to form a third angle 158 that is larger than both the first and second angles. In the embodiment shown, the housings are aligned such that fixture 10 is symmetrical (e.g., about a plane from which the cross-section in FIG. 1B is taken), however, in other embodiments, lower housing 14 may be rotated relative to upper housing 18 (e.g., about a plane defined by the mounting surfaces 50 and 114), and in such embodiments, the present fixtures need not be symmetrical. In some embodiments, lower housing 14 is unitary with upper housing 18 (e.g., formed from a single piece) and/or the housings are otherwise permanently attached. For example, in these embodiments, first channel 34 and second channel 82 each can be parts of a single channel; however, the angular relationships described above can be the same and/or defined relative to a diffuser 162 (described in more detail below), as opposed to mounting surfaces 50 and 114.

Figure 2A:
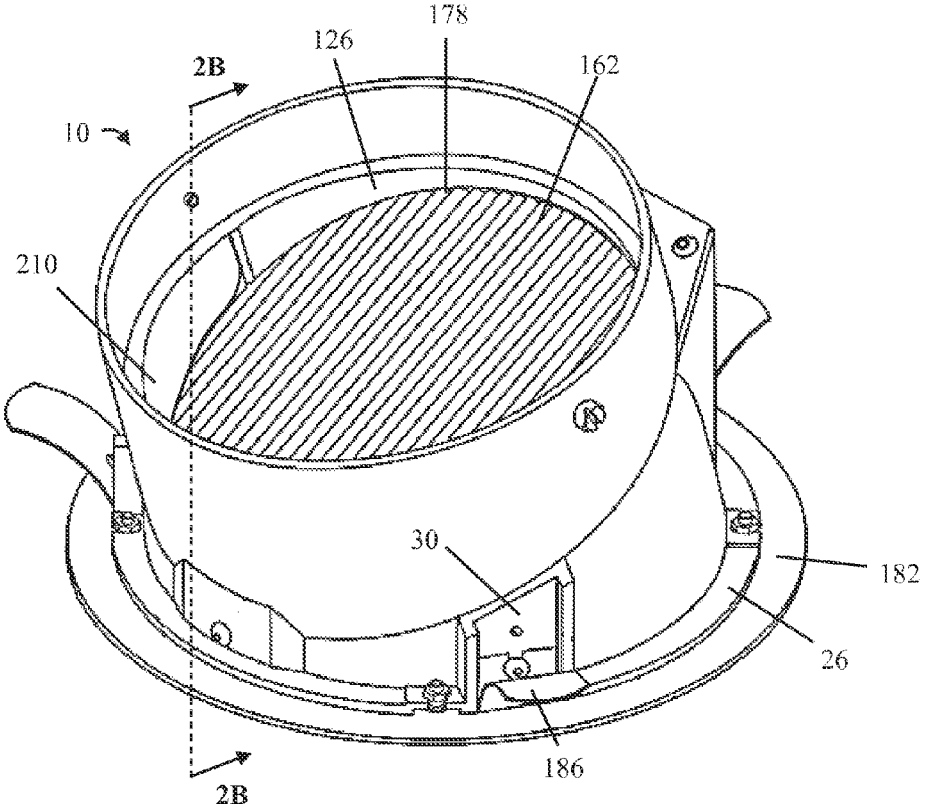
FIGS. 2A and 2B depict perspective and side-cross-sectional views, respectively, of an assembled first embodiment.
Figure 2B:
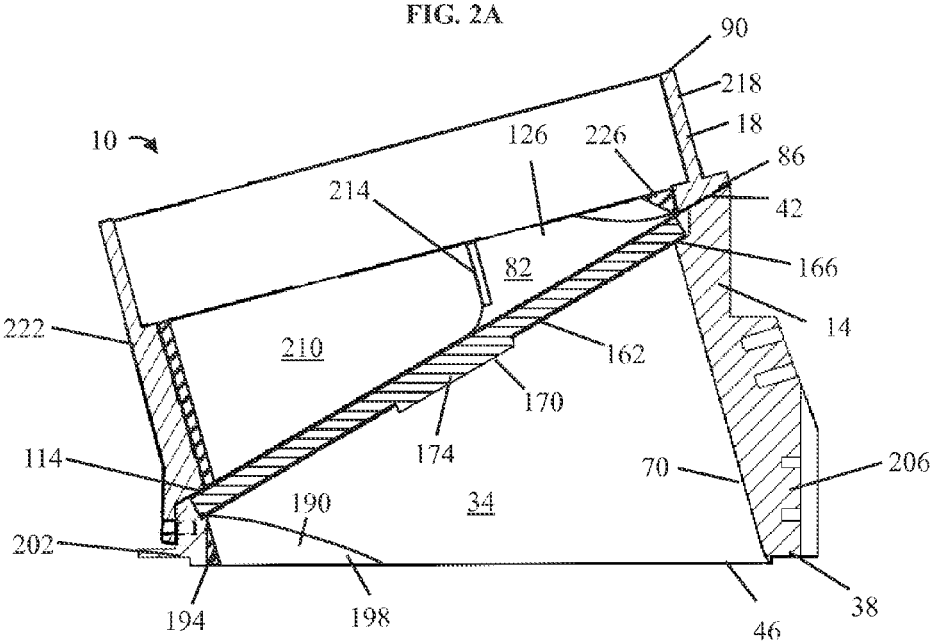

FIGS. 2A and 2B depict the first embodiment in an assembled state. As shown, fixture 10 comprises a diffuser 162. In the embodiment shown, diffuser 162 is configured to be disposed between first mounting surface 50 and second mounting surface 114. In the embodiment shown, diffuser 162 is coupled to lower housing 14. For example, lower housing 14 can comprise a lip or protrusion 166. In this embodiment, lip or protrusion 166 extends inwardly from an interior surface 70 of first channel 34 closer to second end 42 than first end 38 and has a surface configured to support diffuser 162 (e.g., defined at least in part by a recessed portion of second end 42). In the embodiment shown, lip or protrusion 166 can further comprise one or more recessed portion(s) 170 configured to receive protrusions 174 of diffuser 162 (e.g., to further secure diffuser 162 within lower housing 14 and/or within fixture 10). In these and similar embodiments, mounting surface 114 of upper housing 18 can be configured to secure diffuser 162 when the lower housing is coupled to the upper housing (e.g., functioning as diffuser retainer, for example, by having portions that extend laterally over lip or protrusion 166 when the upper housing is coupled to the lower housing). In other embodiments, diffuser 162 can be secured between the lower and upper housings by any suitable structure, such as, for example, fasteners (e.g., screws, rivets, nuts, bolts, and/or the like), adhesive (e.g., glue), a press-fit, and/or the like.

In the embodiment shown, diffuser 162 comprises a corrugated surface 178 (e.g., comprising alternating peaks and troughs) that is configured to diffuse light from a light source (e.g., 106) by scattering and/or spreading light from the light source. In this embodiment, light from a light source may be spread, for example, along a direction perpendicular to surfaces of the peaks and troughs, such as to facilitate the spread of light across a wall when the fixture is installed in, for example, a ceiling. In other embodiments, such diffusing can be accomplished by any suitable structure, such as, for example, a diffuser with sand and/or bead-blasted, tumbled, frosted, and/or otherwise semi-opaque surfaces, lens-type surfaces (e.g., Fresnel cut or otherwise), otherwise optically modified surfaces, and/or gratings, reflectors (described below), filters, and/or the like. Such diffusers can provide more pleasing, softer, and/or more uniform lighting (e.g., wash lighting of a surface), light source concealment (e.g., by redirecting the light).

In the embodiment shown, fixture 10 comprises a trim ring 182 coupled to flange 26 (e.g., through fasteners as shown). Trim ring 182 and/or flange 26 can be configured as a border, insulator, trim plate, flush mounting flange, a zero-sightline mount (e.g., configured to rest against an interior of a surface into which the light fixture is inserted such that mounting hardware is not visible from the exterior of the surface), and/or the like. In the embodiment shown, fixture 10 further comprises one or more mounting clips 186 coupled to hardware mounting surfaces 30 which can be configured to splay outwardly, as shown, in order to retain fixture 10 into a structure. Such mounting clips 186, however, are only shown by way of example, and other mounting structures may be used. For example, hardware mounting surfaces 30 are modular in that they are configured to receive various mounting hardware (e.g., mounting arms which can be retained by fasteners, for example, to secure a light source to the fixture and/or components).

Some of the present fixtures may comprise different and/or additional light altering components within first channel 34 and/or second channel 82. For example, in the embodiment shown, fixture 10 comprises a first reflector 190 disposed in first channel 34 (e.g., within fixture 10 between aperture or opening 46 and diffuser 162). In the embodiment shown, first reflector 190 is a "kick reflector" configured to direct light through aperture or opening 46. In this embodiment, first reflector 190 is a component that can be physically inserted into first channel 34; however, in other embodiments, reflector 190 may comprise any suitable structure, such as, for example, a reflective coating (e.g., a paint), a thin layer of material, and/or otherwise form part of first channel 34. In some embodiments, reflectors of the present fixtures can be disposed over and/or comprise any portion or all of their respective channels. For example, in the embodiment shown, first reflector 190 comprises a substantially triangular cross-section 194 (e.g., having a substantially straight outer edge facing inwardly towards first channel 34) that is revolved around at least a portion of interior surface 70 of first channel 34 (e.g., as shown) and tapers towards ends 198 of the reflector; however, in other embodiments, first reflector 190 may comprise portions with non-triangular or non-rectangular cross-sections (e.g., having a curved outer edge facing inwardly towards first channel 34).

In the embodiment shown, lower housing 14 has a first side 202 and a second side 206 and first reflector 190 is disposed closer to first side 202 than to second side 206. As shown, at second side 206, first end 38 is further apart from second end 42 than at first side 202 (e.g., lower housing 14 is substantially wedge-shaped as described above). Such placement can facilitate reflector 190 in functioning as a "kick reflector," for example, when fixture 10 is installed in a ceiling, fixture 10 can cast light onto a wall to a height nearer to the ceiling than a fixture without such a reflector. Additionally, reflector 190 can facilitate a more uniform distribution of light with less defined boundaries (e.g., dark areas) at the extremities of the lighted areas.

In the embodiment shown, fixture 10 comprises a second reflector 210 in second channel 82 (e.g., within fixture 10 between light mount 94 and diffuser 162). For example, in the embodiment shown, second reflector 210 comprises a thin sheet of reflective material (e.g., a white diffuse reflector and/or a metallic or semi-metallic reflector) having a substantially rectangular cross-section with a straight outer edge facing towards second channel 82. In other embodiments, second reflector 210 can comprise a triangular cross-section and/or a cross-section with a curved outer edge, similarly to as described above for first reflector 190. White diffuse reflectors suitable for use in some embodiments of the present fixtures can be provided as a sheet of material and can be cut to fit within second channel 82. In the embodiment shown, second reflector 210 can be secured and/or retained within second channel 82, for example, through protrusions 214 that extend from an interior surface 126 of second channel 82 (e.g., the second reflector can flexible and/or spring-like and retained in a deflected condition by protrusions 214, as shown). In other embodiments second reflector can comprise a paint, coating, and/or the like disposed on interior surface 126.

In the embodiment shown, upper housing 18 has a first side 218 and a second side 222 and second reflector 210 is disposed closer to second side 222 than to first side 218. As shown, at second side 222, first end 86 is further from second end 90 than at first side 218 (e.g., upper housing is substantially wedge-shaped, as described above). Such placement can provide and/or facilitate the same and/or similar desirable lighting characteristics as described above for first reflector 190.

In the embodiment shown, fixture 10 further comprises a third reflector 226 in second channel 82 opposite (e.g., on a substantially opposite side of second channel 82 from) second reflector 210. As shown, third reflector 226 can be similar in size, cross-section (e.g., having straight and/or curved outer edges), and/or function to first reflector 190 (e.g., can be a "kick reflector" disposed on an opposite side of diffuser 162 from first reflector 190, such that reflectors 190 and 226 act as "symmetric kick reflectors").

Figure 3A:
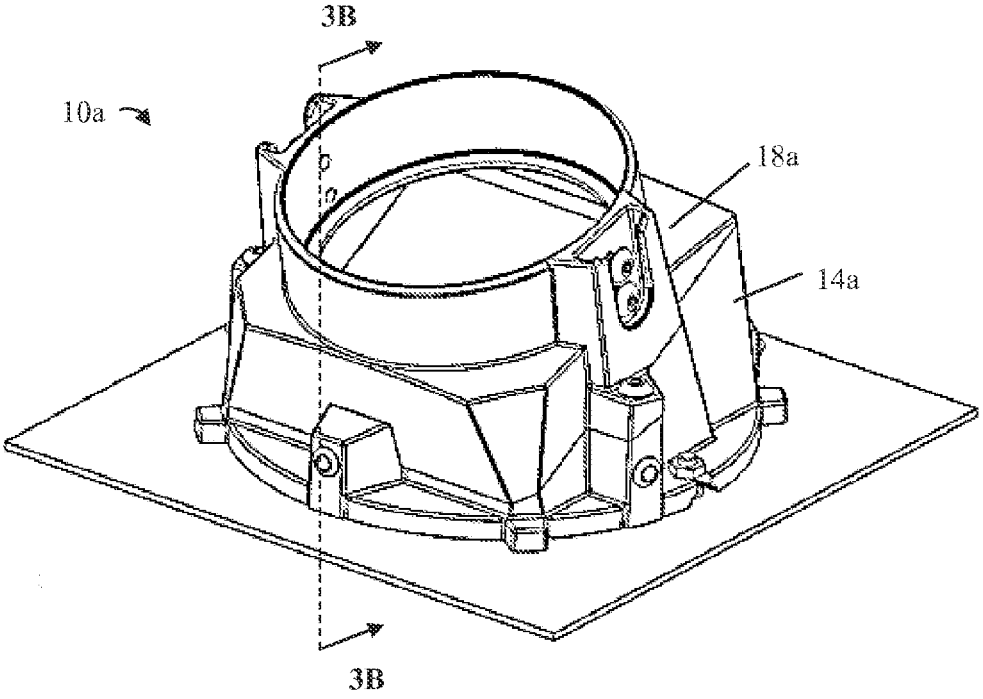
FIG. 3A-3C depict perspective, side cross-sectional, and top views, respectively, of a second embodiment of the present fixtures.
Figure 3B:
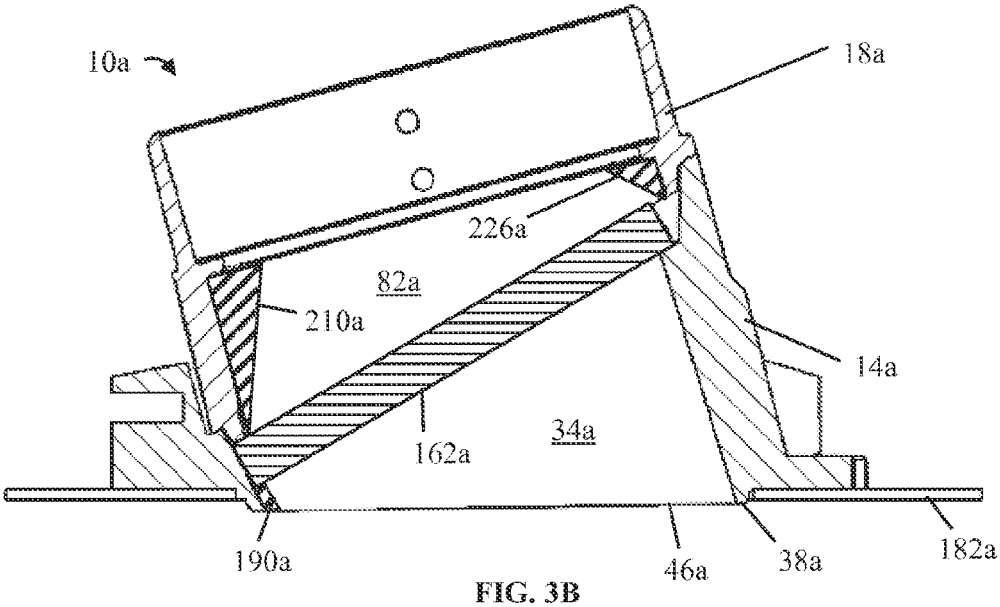
Figure 3C:
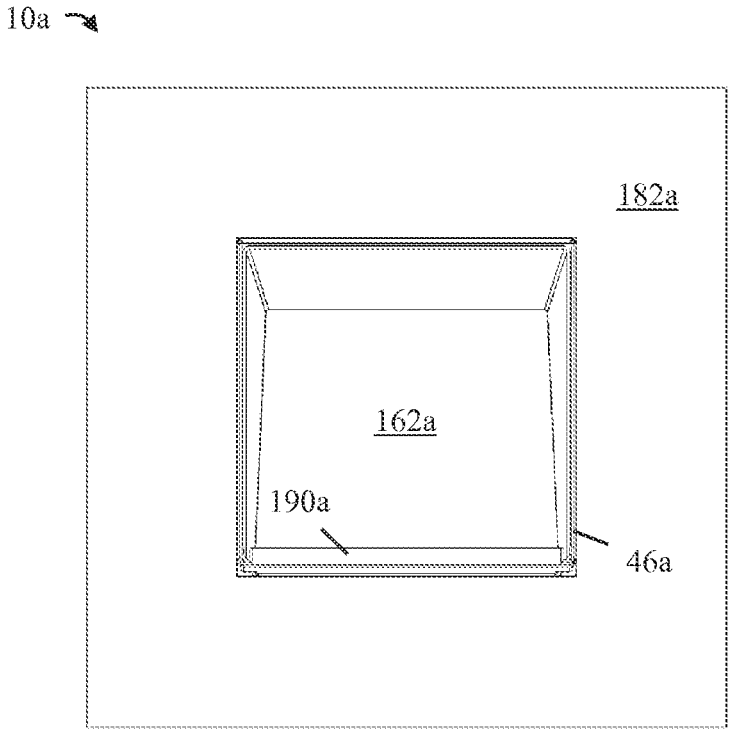

FIGS. 3A-3C depict perspective, cross-sectional side, and top views, respectively, of a second embodiment **10*a* of the present fixtures. Fixture 10*a* is substantially similar to fixture 10, with the primary exception that fixture 10*a* comprises a generally rectangular cross-sectional shape (e.g., channels 34*a* and/or 82*a* having substantially rectangular cross-sections). In this way, fixture 10*a* may provide certain advantages over a generally circular design (e.g., fixture 10), such as, for example, less complex reflector design to achieve a desired wall wash lighting effect. As shown in FIG. 3C, fixture 10*a* comprises a generally rectangular (e.g., square) aperture or opening 46*a* defined by a first end 38*a* of lower housing 14*a* (e.g., corresponding to a generally rectangular first channel 34*a*). In this embodiment, aperture or opening 46*a* is surrounded by a substantially rectangular trim ring 182*a*. Additionally, in the embodiment shown, diffuser 162*a* is substantially rectangular (e.g., to reflect, filter, and/or diffuse light passing through rectangular first and second channels of fixture 10*a*). In the depicted embodiment, reflectors 210*a*, 226*a*, and 190*a* comprise substantially triangular cross-sections that span (e.g., are extruded across) their respective channels on only a single side of the channel (e.g., as shown, as opposed to revolved around their respective channels as in fixture 10) (e.g., a relatively less complex reflector design). However, in other embodiments, any and/or all of the reflectors may comprise portions that are disposed on any number of sides of their respective channels (e.g., the reflectors may comprise rectangular rings that completely surround their respective channels). Otherwise, reflectors 210*a*, 226*a*, and/or 190*a* can comprise any and/or all of the features described above for reflectors 210, 226, and/or 190*a* (e.g., reflectors 210*a*, 226*a*, and/or 190*a* can be substantially similar to reflectors 210, 226, and 190**).

Figure 4:
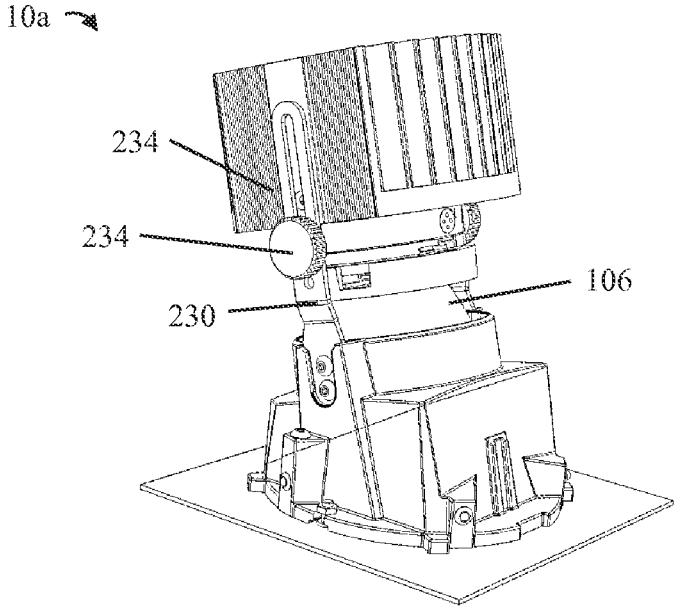
FIG. 4 depicts a perspective view of an assembled second embodiment.

FIG. 4 depicts the second embodiment **10*a* of the present fixtures in an assembled state, configured to be inserted into a wall, ceiling, or other structure for use. In this embodiment, fixture 10*a* is coupled (e.g., by mounting arms 230 and thumb screws 234) to a heat sink 234 which can be configured to secure light source 106** into the light mount (described above) and/or contain electrical components which may be necessary for operation of the fixture.

The above specification and examples provide a complete description of the structure and use of exemplary embodiments.

Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A light fixture comprising:

a lower housing defining a first channel and having first and second ends, the first end defining an aperture and the second end having a first mounting surface disposed at a non-parallel first angle relative to a plane of the aperture;

an upper housing defining a second channel and having a first end and a second end, the second end comprising a light mount and the first end comprising a second mounting surface disposed at a non-parallel second angle relative to a plane of the light mount; and a diffuser configured to be disposed between the first mounting surface and the second mounting surface;

where the first mounting surface is configured to be coupled to the second mounting surface to couple the lower housing to the upper housing such that the light mount is disposed at a non-parallel third angle relative to the aperture.

2. The light fixture of claim 1, where the light mount is configured to receive a light source having a primary aperture, and the plane of the light mount is substantially parallel with a plane defined by the primary aperture.

3. The light fixture of claim 1, where the third angle is substantially equal to the first angle minus the second angle.

4. The light fixture of claim 1, where the first angle is approximately two times the second angle.

5. The light fixture of claim 1, where the first angle is approximately 30 degrees.

6. The light fixture of claim 1, further comprising a first reflector disposed in the first channel.

7. The light fixture of claim 6, where the first reflector comprises a cross-section with a straight outer edge facing towards the first channel.

8. The light fixture of claim 6, where the first reflector comprises a cross-section with a curved outer edge facing towards the first channel.

9. The light fixture of claim 6, where the lower housing has a first side and a second side at which the first and second ends of the lower housing are further apart than at the first side, and the first reflector is disposed on an interior surface of the first channel closer to the first side than the second side.

10. The light fixture of claim 1, further comprising a second reflector disposed in the second channel.

11. The light fixture of claim 10, where the second reflector comprises a cross-section with a straight outer edge facing towards the second channel.

12. The light fixture of claim 10, where the second reflector comprises a cross-section with a curved outer edge facing towards the second channel.

13. The light fixture of claim 10, where the upper housing has a first side and a second side at which the first and second ends of the upper housing are further apart than at the first side, and the second reflector is disposed on an interior surface of the second channel closer to the second side than the first side.

14. The light fixture of claim 1, where the aperture is substantially rectangular.

15. The light fixture of claim 1, further comprising a lip extending inward from an interior surface of the first channel closer to the second end than the first end, the lip having a surface configured to support the diffuser.

* * * * *